United States Patent [19]

Maliszewski

[11] Patent Number: 4,610,401

[45] Date of Patent: Sep. 9, 1986

[54] TRIMETAL PULVERIZER ROLL

[75] Inventor: Theodore V. Maliszewski, North Canton, Conn.

[73] Assignee: Combustion Engineering, Inc., Windsor, Conn.

[21] Appl. No.: 764,802

[22] Filed: Aug. 12, 1985

Related U.S. Application Data

[63] Continuation of Ser. No. 446,850, Dec. 6, 1982, abandoned.

[51] Int. Cl.[4] ..... B02C 4/30

[52] U.S. Cl. ..... 241/294; 241/298; 241/300

[58] Field of Search ..... 241/293, 294, 295, 298, 241/300, 301; 29/132

[56] References Cited

U.S. PATENT DOCUMENTS 2,964,251 12/1960 Samuels et al. ..... 241/293

3,409,236 11/1968 Hamilton et al. ..... 241/232

*Primary Examiner*—Howard N. Goldberg

*Assistant Examiner*—Timothy V. Eley

*Attorney, Agent, or Firm*—Arthur E. Fournier, Jr.

[57] ABSTRACT

A pulverizer, i.e., grinding, roll (18) of the type that is particularly suited for embodiment in a bowl mill (10) wherein the roll (18) coacts with another surface (14) within the mill (10) to effect the pulverization therewithin of a material such as coal. The subject roll (18) embodies a trimetal form of construction. More specifically, the core material, i.e., the first or inner layer (50), of the trimetal roll (18) consists of a relatively soft material that is noted for its good machinability. The next, i.e., second or intermediate, layer (52) of the trimetal roll (18) comprises a material that has medium wear-resistant qualities. The last, i.e., third or outer, layer (54) of the trimetal roll (18) comprises a material having higly abrasive resistant qualities. In addition, there is provided a method of manufacturing such a trimetal roll (18).

4 Claims, 3 Drawing Figures

TRIMETAL PULVERIZER ROLL

This is a continuation of application Ser. No. 446,850 filed Dec. 6, 1982 now abandoned.

BACKGROUND OF THE INVENTION

This invention relates to rolls, and more specifically to a trimetal pulverizer roll of the type that is intended to be used in bowl mills for purposes of effecting the pulverization therein of material such as, for example, coal and to a method of manufacturing such a trimetal pulverizer roll.

An essential component of any steam generation system of the type, which utilizes pulverized coal as a fuel, is the apparatus in which the coal is pulverized in order to render it suitable for such usage. Although the prior art is replete with examples of various types of apparatus that have been employed for purposes of accomplishing coal pulverization, one form of apparatus, which in particular has frequently been used for this purpose, is that commonly referred to as a bowl mill. The latter obtains its name principally from the fact that the pulverization, i.e., grinding, of the coal that takes place therewithin occurs on a grinding surface, which insofar as configuration is concerned resembles somewhat a bowl.

For an exemplary showing of a prior art form of bowl mill, reference may be had to U.S. Pat. No. 3,465,971, which is assigned to the same assignee as the present invention. U.S. Pat. No. 3,465,971 contains a teaching of both the nature of the construction and the mode of operation of a bowl mill that is suitable for use for purposes of effecting the pulverization of the coal that is used to fuel a coal-fired steam generator. As set forth in this patent, the essential components of such a bowl mill are a body portion, i.e., housing, within which a grinding table is mounted for rotation, a plurality of grinding rolls that are supported in equally spaced relation one to another, the plurality of grinding rolls are suitably arranged in such a manner so as to coact with the grinding table such that coal which is disposed on the surface of the grinding table is capable of being ground, i.e., pulverized, by the rolls, coal supply means for feeding to the surface of the grinding table the coal which is to be pulverized in the bowl mill, and air supply means for providing to the interior of the body portion the air that is required in the operation of the bowl mill.

In order to satisfy the demands for pulverized coal of a coal-fired steam generation system that embodies a conventional form of construction, there commonly exists a need to employ a plurality of bowl mills of the type which are shown in the aforereferenced patent. In this regard, note is further made here of the fact that in terms of capacity each of these bowl mills may have a capacity of up to one hundred tons per hour of pulverized coal. In addition to possessing the capability of operating at its maximum capacity, each of these bowl mills must also be capable of operating at less than full capacity, i.e., at some percentage thereof, e.g., 25%, 50%, 75%, etc. Finally, these bowl mills must also be capable of use with a variety of types of coal that have dissimilar grinding characteristics.

With further reference to the aforementioned patent, the mode of construction of the grinding rolls that are depicted therein is such that each grinding roll is designed to be mounted on a shaft-like member. As a result the grinding rolls are each capable of movement relative to the surface of the grinding table. To effect the assembly of the grinding roll with the aforesaid shaft-like member, each grinding roll preferably has a through passage formed through the center thereof. The function of this through passage is to enable the shaft-like member to be positioned therewithin in mounted relation thereto. Accordingly, in order to facilitate the task of providing the grinding roll with such a through passage, it is desirable that the grinding roll be composed of a material that is characterized by its ease of machinability, i.e., a relatively soft material such as gray iron.

On the other hand, in addition to it being desirable to form the grinding roll of a material that is relatively soft, there exists also a need for at least the external, i.e., outer, surface of the grinding roll to consist of a material that is characterized by its good wear-resistant qualities. The primary reason for this is that the grinding rolls in the course of effecting the pulverization of material therewith are of necessity subjected to a harsh abrasive action, the latter being occasioned by virtue of the nature of the material that is being pulverized as well as by virtue of the manner in which this pulverization takes place. The result, therefore, is that the grinding rolls exhibit a susceptibility to being rendered unusable in a relatively short period of time. That is, the rolls are found to have a relatively short operating life. For obvious reasons, it is desirable that such a result be avoided, if possible. As is known to those who are skilled in this art, the wear, which the grinding rolls that are employed in bowl mills actually experience, is influenced principally by the grinding characteristics of the material that is being pulverized as well as by the productive output of the bowl mill, i.e., the amount of material that is being pulverized in the bowl mill in a given period of time.

When the external, i.e., outer, surface of the pulverizer, i.e., grinding, roll becomes sufficiently worn so as to preclude any further use thereof for purposes of effecting the pulverization of material therewith, the remaining portions of the roll are normally still functional. That is, the grinding roll but for its worn external surface would still be serviceable. Thus, from the standpoint of achieving economies of manufacture, it would be desirable, if possible, to effect a resurfacing of the external surface of the grinding roll such that the latter might once again be utilized for the pulverization of material rather than necessitating that the worn grinding roll be replaced by one that is entirely new. Further to this point, one would normally expect that the cost of reconditioning, i.e., resurfacing, the outer surface of a worn grinding roll would be significantly less than the cost associated with the manufacture of an entirely new grinding roll.

In addition to the relative cost of resurfacing the external, i.e., outer, surface of a worn grinding roll as contrasted to the cost of manufacturing an entirely new grinding roll, there also exists the matter of the operating life which is achievable with a resurfaced worn grinding roll as contrasted to that which is obtainable with an entirely new grinding roll. Namely, in order to be economically feasible it is desirable that the operating life of a resurfaced worn grinding roll be approximately equivalent to that which one would obtain from a new grinding roll. That is, any savings which are achievable from making use of a resurfaced worn grinding roll as contrasted to employing an entirely new grinding roll should not be dissipated as a consequence of the fact that the operating life of a worn grinding roll is such that several resurfacings thereof are required in order to realize the same operating life that can be realized with a grinding roll that is totally new. To summarize, if in the interest of obtaining comparable operating lives, multiple resurfacings would have to be had of the worn grinding roll such that the cost thereof would probably equal, if not exceed, the cost of providing an entirely new grinding roll, then, the advantages accruing from reusing a worn grinding roll vis-a-vis replacing the latter with a new grinding roll would undoubtedly not be realized.

It has been known in the prior art to resurface a worn grinding roll. Further, the results obtainable therefrom have proven to be generally satisfactory. Most often, this resurfacing has been in the form of providing the external surface of the worn grinding roll with a suitably dimensioned layer of weld metal. In view of this experience which the prior art has had with the resurfacing of a worn grinding roll, there have been attempts made at providing the external surface of new grinding rolls with a hard facing. Unfortunately, however, such attempts applied to new grinding rolls have not heretodate met with much success.

The motivation behind the attempt to effect a resurfacing of new grinding rolls has largely resided in the desire to extend the operating life thereof. One of the major reasons for seeking to extend the operating life of new grinding rolls is that it would enable the period to be extended between when shutdowns are required to accomplish the removal of worn grinding rolls and the replacement thereof with new grinding rolls. Furthermore, when consideration is given to the fact that each bowl mill normally embodies three grinding rolls, each of which periodically must be removed and replaced when it becomes worn, as well as the fact that a plurality of bowl mills are commonly employed to provide the requisite amount of pulverized coal to a coal-fired steam generation system, the magnitude of the problem that is presented by the need to effect a shut down of the bowl mill for purposes of accomplishing the removal and replacement of worn grinding rolls while concomitantly ensuring that the power generation system retains the capability to provide continuous uninterrupted service should be readily apparent.

In addition to the above there is also the matter of the expenditure of time and effort along with the cost per se that is associated with the act of removing and replacing a worn grinding roll. Obviously, therefore, if one were to be successful in achieving a reduction in the frequency with which grinding rolls are required to be replaced as a consequence of their having become worn, cost savings could be realized in terms of the time and effort that is required to be expended to effect such replacement. There has been shown to exist in the prior art a need for a new and improved form of grinding roll that is characterized by the fact that this new grinding roll possesses a significantly longer operating life than that commonly found to be possessed by prior art forms of grinding rolls. In addition, a need has been demonstrated for a new and improved method for manufacturing such a new and improved form of grinding roll.

It is, therefore, an object of the present invention to provide a new and improved form of pulverizer roll.

It is another object of the present invention to provide such a pulverizer roll which is characterized in that it embodies a trimetal mode of construction.

It is still another object of the present invention to provide such a trimetal pulverizer roll that is primarily intended to be employed in a bowl mill for purposes of effecting the pulverization therewithin of a material such as coal.

A further object of the present invention is to provide such a trimetal pulverizer roll that is distinguishable by its relatively long operating life.

A still further object of the present invention is to provide such a trimetal pulverizer roll having a first portion thereof that is characterized by its ease of machinability, a second portion thereof that is characterized by the fact that it exhibits medium wear-resistant qualities, and a third portion thereof that is characterized by the fact that it exhibits highly abrasive resistant qualities.

Yet another object of the present invention is to provide such a trimetal pulverizer roll that while being readily employable in a bowl mill yet also enables significant cost savings to be realized through the use thereof insofar as the operation of the bowl mill is concerned.

Yet still another object of the present invention is to provide a new and improved method of manufacturing such a trimetal pulverizer roll.

SUMMARY OF THE INVENTION

In accordance with one aspect of the present invention there is provided a pulverizer, i.e., grinding roll of the type that is particularly suited for employment in a bowl mill. When mounted in the bowl mill, the subject roll is designed to be operative to coact with another surface of the bowl mill in order to accomplish the pulverization within the bowl mill of material such as coal. To this end, the subject roll embodies a trimetal form of construction. More specifically, the subject roll incorporates a first, i.e., inner, portion which is made of material that is characterized by its ease of machinability, as for example, gray iron. Further, this inner portion has formed therethrough a passage which is suitably dimensioned for receiving therewithin a shaft-like member on which the roll is designed to be mounted in supported relation thereto. Next, the subject roll incorporates a second, i.e., intermediate, portion of material that is suitably supported in adhered relation on the inner portion. This intermediate portion, which is substantially uniform in thickness, is composed of a material that is noted for its medium wear-resistant qualities such as a material like Raymix, the latter being obtainable from applicant's assignee. Lastly, the subject roll incorporates a third, i.e., outer, portion that is suitably supported in adhered relation on the intermediate portion. This outer portion is substantially uneven in thickness. That is, those areas of the outer portion of the subject roll that are known to wear most rapidly are provided with a thicker thickness of material. Finally this outer portion is composed of a highly abrasive resistant material such as a weld overlay material.

In accordance with another aspect of the present invention there is provided a method of manufacturing such a trimetal pulverizer, i.e., grinding roll. The subject method includes the steps of forming from a material that is characterized by its ease of machinability a body having the general configuration of a roll, providing through the center of the body a suitably dimensioned through passage capable of having a shaft-like support member positioned therewithin in mounted relation thereto, affixing in supported relation to the body a first substantially uniform layer of material having medium wear-resistant characteristics, and affixing in supported relation to the first layer of material a second substantially nonuniform layer of material having highly abrasive resistant characteristics.

DESCRIPTION OF A PREFERRED EMBODIMENT

Figure 1:
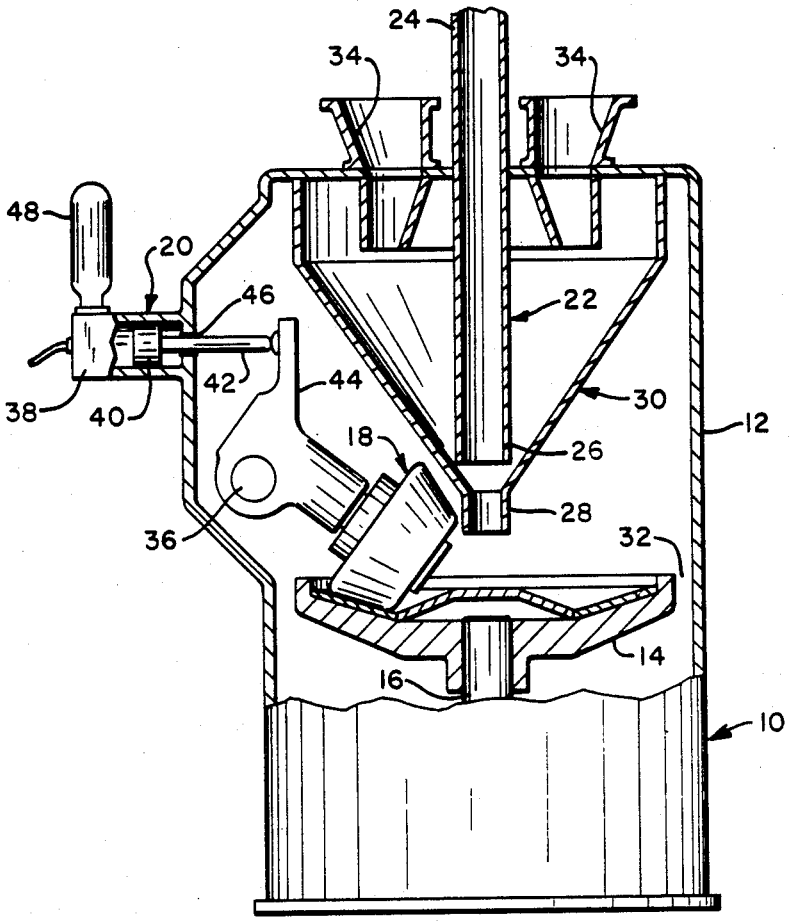
FIG. 1 is a side elevational view partly in section and with some parts broken away of a bowl mill embodying pulverizer rolls constructed in accordance with the present invention and manufactured in accordance with the method of the present invention.

Referring now to the drawing, and more particularly to FIG. 1 thereof, there is depicted therein a pulverizing bowl mill, generally designated by reference numeral 10. Inasmuch as the nature of the construction and the mode of operation of pulverizing bowl mills per se are well-known to those skilled in the art, it is, therefore, not deemed necessary to set forth herein a detailed description of the bowl mill 10, which is illustrated in FIG. 1. Rather, it is deemed sufficient for purposes of obtaining an understanding of a pulverizing bowl mill 10, which is capable of being equipped with pulverizer rolls constructed in accordance with the present invention and manufactured by means of the present invention, that there merely be presented herein a generalized description of the nature of the construction and the mode of operation of the components of the pulverizing bowl mill 10. For a more detailed description of the nature of the construction and the mode of operation of the components of the pulverizing bowl mill 10, which are not described in depth herein, one may have reference to the prior art, e.g., U.S. Pat. No. 3,465,971, which issued Sept. 9, 1969 to J. F. Dalenberg et al., and/or U.S. Pat. No. 4,002,299, which issued Jan. 11, 1977 to C. J. Skalka.

Referring further to FIG. 1 of the drawing, the pulverizing bowl mill 10, as illustrated therein, includes a substantially closed separator body 12. A grinding table 14 is mounted on a shaft 16, which in turn is operatively connected to a suitable drive mechanism (not shown), so as to be capable of being rotatably driven thereby. With aforedescribed components arranged within the separator body 12 in the manner depicted in FIG. 1 of the drawing, the grinding table 14 is designed to be driven in a clockwise direction.

Continuing with a description of the pulverizing bowl mill 10, a plurality of pulverizer, i.e., grinding, rolls 18, preferably three in number in accord with conventional practice, are suitably supported within the interior of the separator body 12 so as to be spaced equidistantly one from another around the circumference of the latter. The nature of the construction as well as the method by which each of the grinding rolls 18 is manufactured comprises the subject matter that forms the essence of the present invention. A description of the nature of the construction of the grinding rolls 18 as well as a description of the method by which such a grinding roll 18 is manufactured will be found set forth hereinafter. First, however, note is made here of the fact that in the interest of maintaining clarity of illustration in the drawing only one grinding roll 18 has been shown in FIG. 1.

As further regards the grinding rolls 18, each of the latter, as best understood with reference to FIG. 1 of the drawing, is preferably supported on a suitable shaft (not shown) such as to be rotatable relative thereto. Moreover, the grinding rolls 18 are also each suitably supported in a manner yet to be described for movement relative to the upper surface, as viewed with reference to FIG. 1, of the grinding table 14. To this end, each of the grinding rolls 18 has cooperatively associated therewith a hydraulic means, generally designated in FIG. 1 by reference numeral 20. Each of the hydraulic means 20, as will be described more fully hereinafter, is operative to establish a hydraulic loading on the grinding roll 18 that is associated therewith. The effect of this loading is to cause the roll 18, which is subject thereto, to exert the requisite degree of force on the coal that is disposed on the grinding table 14, and thereby accomplish the desired pulverization of this coal.

The material, e.g., coal, that is to be pulverized in the bowl mill 10 is fed thereto by means of any suitable conventional form of feed means. By way of exemplification in this regard, one such feed means that may be employed for this purpose is a belt feeder means (not shown). Upon being discharged from the feed means (not shown), the coal enters the bowl mill 10 by means of a coal supply means, generally designated by reference numeral 22, with which the separator body 12 is suitably provided. In accordance with the embodiment of the pulverizing bowl mill 10 illustrated in FIG. 1, the coal supply means 22 includes a suitably dimensioned duct 24 having one end thereof, which extends outwardly of the separator body 12 and preferably terminates in a funnel-like member (not shown). The latter member (not shown) is suitably shaped so as to facilitate the collection of the coal particles entering the bowl mill 10, and the guiding thereafter of these coal particles into the duct 24. To this end, as shown in FIG. 1 of the drawing, the duct end 26 preferably is suitably supported within the separator body 12 through the use of any suitable form of conventional support means (not shown) such that the duct end 26 is coaxially aligned with the shaft 16 that supports the grinding table 14 for rotation, and is located in spaced relation to a suitable outlet 28 provided in the classifier, generally designated by reference numeral 30, through which the coal flows in the course of being fed onto the surface of the grinding table 14.

In accord with the mode of operation of pulverizing bowl mills that embody the form of construction depicted in FIG. 1, a gas such as air is utilized to effect the conveyance of the coal from the grinding table 14 through the interior of the separator body 12 for discharge from the pulverizing bowl mill 10. The air that is made use of in this regard enters the separator body 12 through a suitable opening (not shown) formed therein for this purpose. From the aforesaid opening (not shown) in the separator body 12, the air flows to a multiplicity of annular spaces 32 suitably formed between the circumference of the grinding table 14 and the inner wall surface of the separator body 12. The air upon exiting from the annular spaces 32 is deflected over the grinding table 14 by means of suitably positioned deflector means (not shown). One such form of deflector means (not shown), which is suitable for use for this purpose in the bowl mill 10 of FIG. 1 comprises the subject matter of U.S. Pat. No. 4,234,132 which issued to applicant on Nov. 18, 1980, and which is assigned to the same assignee as the present application.

While the air is flowing along the path described above, the coal which is disposed on the surface of the grinding table 14 is being pulverized by the action of the grinding rolls 18. As the coal becomes pulverized, the particles are by centrifugal force thrown outwardly away from the center of the grinding table 14. Upon reaching the region of the circumference of the grinding table 14, the coal particles are picked up by the air exiting from the annular spaces 32 and are carried along therewith. The combined flow of air and coal particles is thereafter captured by the deflector means (not shown), which has been referred to previously hereinabove. The deflector means (not shown), in turn, is operative to cause this combined flow of air and coal particles to be deflected over the grinding table 14. This necessitates a change in direction in the path of flow of this combined stream of air and coal particles. In the course of effecting this change of direction, the heaviest coal particles, because they have more inertia, become separated from the air stream, and fall back onto the surface of the grinding table 14, whereupon they undergo further pulverization. The lighter coal particles, on the other hand, because they have less inertia continue to be carried along in the air stream.

After leaving the influence of the aforedescribed deflector means (not shown), the combined stream consisting of air and those coal particles that remain entrained therein flows to the classifier means 30 to which reference has been had herein previously. In accord with conventional practice and in a manner which is well-known to those skilled in this art, the classifier 30 operates to effect a further sorting of the coal particles that remain in the air stream. Namely, those particles of pulverized coal, which are of the desired particle size, pass through the classifier 30 and along with the air are discharged therefrom and thereby from the bowl mill 10. This discharging of the coal particles is effected through the outlets 34 with which the bowl mill 10 is suitably provided for this purpose.

On the other hand, those coal particles, which in size are larger than desired, are returned to the surface of the grinding table 14 whereupon they undergo further pulverization. Thereafter, these coal particles are once again subjected to the process that has been described above. That is, these particles are thrown outwardly of the grinding table 14, are picked up by the air exiting from the annular spaces 32, are carried along with the air to the deflector means (not shown), are deflected back over the grinding table 14 by the deflector means (not shown), the heavier particles drop back onto the grinding table 14, the lighter particles are carried along to the classifier 30, and finally those particles which are of the proper size pass through the classifier 30 and exit from the bowl mill 10 through the outlets 34.

Considering further the matter of the pulverizing action to which the coal disposed on the upper surface, as viewed with reference to FIG. 1, of the grinding table 14 is subjected by the grinding rolls 18, the amount of force that must be exerted on the latter in order to effect the desired degree of pulverization of the coal mill vary depending on a number of factors. For example, one important consideration in this regard is the nature of the coal itself. That is, the amount of force required to pulverize the coal will be a function of the grindability of the coal to be pulverized, i.e., the grinding characteristics of the latter. Another important factor in determining the amount of force that the grinding rolls 18 must exert to accomplish the desired degree of pulverization of the coal is the depth to which the coal is disposed on the grinding table 14, which in turn is a function of the output rate at which the bowl mill 10 is being operated.

As best understood with reference to FIG. 1 of the drawing, the amount of grinding force which the grinding rolls 18 apply to the coal on the grinding table 14 is a function of the amount of force with which the grinding rolls 18 are biased into engagement with the coal on the table 14. In accord with the nature of the construction shown in FIG. 1, the grinding roll 18 depicted therein, which is suitably mounted for rotation on a shaft (not shown), is suitably supported so as to be pivotable about the pivot pin 36 into and out of engagement with the coal that is disposed on the grinding table 14. Although only one grinding roll 18 is shown in FIG. 1 and although this discussion is directed to this one grinding roll 18, it is to be understood that as has been mentioned previously hereinbefore the bowl mill 10 is normally provided with three such grinding rolls 18. Therefore, this discussion is intended to be equally applicable to each of these three grinding rolls 18.

Continuing with the matter of the force exerted by the grinding roll 18, the latter in accord with the nature of the construction illustrated in FIG. 1 is designed to be biased hydraulically into and out of engagement with the coal that is on the grinding table 14. More specifically, to this end the hydraulic means 20 is cooperatively associated with the grinding roll 18. As depicted in FIG. 1, the hydraulic means 20 includes a cylinder 38 suitably mounted to the exterior wall surface of the separator body 12. Within the cylinder 38, a piston 40 is suitably supported for movement therewithin. Attached to the piston 40 is a piston rod 42 of sufficient length so as to extend into the interior of the separator body 12 whereupon the free end of the piston rod 42 engages an upstanding member 44 that comprises a portion of the support means for the grinding roll 18. A suitable opening 46 is formed in the separator body 12 to enable the piston rod 42 to project into the interior of the latter. In a manner well-known to those skilled in the art of hydraulics, the cylinder is filled with a suitable hydraulic fluid, such that a hydraulic pressure is applied by the fluid to both faces of the piston 40. The hydraulic fluid which fills the cylinder 38 is provided thereto from a suitable source thereof (not shown).

Accordingly, the extent to which the free end of the piston rod 42 projects into the interior of the separator body 12 for engagement with the member 44 is a function of the difference in hydraulic pressure, which is applied to the faces of the piston 40. In turn, the extent to which the free end of the piston rod 42 extends into the interior of the separator body 12 determines the extent to which the grinding roll 18 is hydraulically biased into engagement with the coal on the grinding table 14, and concomitantly the amount of grinding force being applied to the coal by the grinding roll 18. That is, the piston rod 42 is fixedly attached to one face of the piston 40 such that as the piston 40 moves in response to the difference in hydraulic pressure being applied to the faces thereof, the piston rod 42 moves along therewith. It is to be understood in this connection that the opening 46 provided in the separator body 12 through which the piston rod 42 passes is equipped with suitable sealing means (not shown) operative to prevent the leakage through the opening 46 of hydraulic fluid from the cylinder 38 to the interior of the body 12.

By way of exemplification, the more the free end of the piston rod 42 extends into the interior of the separator body 12, the more it will cause the member 44 to move in a clockwise direction, as viewed with reference to FIG. 1, about the pivot pin 36, and thereby have the effect of increasing the amount of grinding force that the grinding roll 18 exerts on the coal that is on the grinding table 14. Conversely, the less the free end of the piston rod 42 projects into the interior of the separator body 12, the less clockwise movement there will be of the member 44 about the pivot pin 36, and thus the less grinding force the roll 18 will exert on the coal that is disposed on the table 14.

Lastly, in accord with the preferred form of construction, the hydraulic means 20 is provided with an accumulator 48. The function of the latter is to obviate any potentially damaging consequences that might otherwise flow from the occurrence of some form of transient operating condition. For example, should some foreign object be introduced into the bowl mill 10 along with the coal that is to be pulverized, and should this foreign object become disposed on the grinding table 14, the effect of the grinding roll 18 engaging this foreign object would be to raise the roll 18 away from the table 14, i.e., would be to cause the roll 18 to move about the pivot pin 36 in a counterclockwise direction, as viewed with reference to FIG. 1. As a consequence of this action, the member 44 would be made to apply a force against the free end of the piston rod 42 tending to cause the piston 40 to move in a direction away from the wall surface of the separator body 12. Further, as the piston 40 moves in this manner, the hydraulic fluid located in that portion of the cylinder 38 towards which the piston 40 is moving would tend, absent the presence of the accumulator 48, to resist the movement of the piston 40. This could result in damage being incurred by the various components that are operatively associated with the grinding roll 18.

Accordingly, the function of the accumulator 48 is to permit hydraulic fluid to flow thereinto as the fluid is being forced from the cylinder 38 by the advancing piston 40. However, as soon as the grinding roll 18 passes over the foreign object, the grinding roll 18 is once again restored to its normal position, i.e., nontransient condition. This occurs by virtue of the flow from the accumulator 48 into the cylinder 38 of the hydraulic fluid which had been made to flow into the former from the latter, because of the counterclockwise movement, as viewed with reference to FIG. 1, of the grinding roll 18 about the pivot pin 36 caused by the raising of the roll 18 as the latter engaged and passed over the foreign object located on the table 14.

Figure 2:
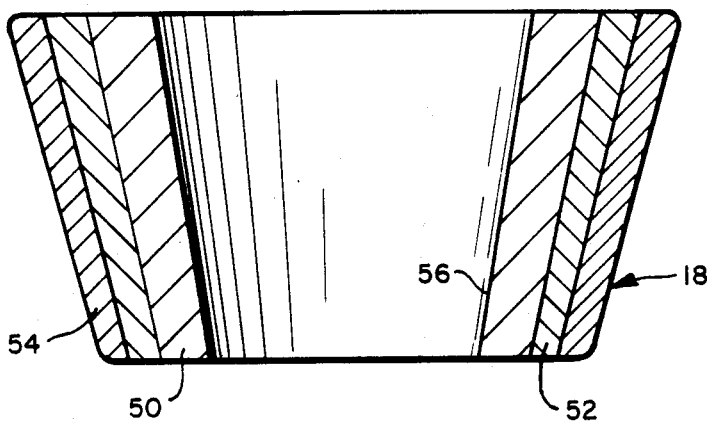
FIG. 2 is a sectional view on an enlarged scale of a pulverizer roll constructed in accordance with the present invention and manufactured in accordance with the method of the present invention.
Figure 3:
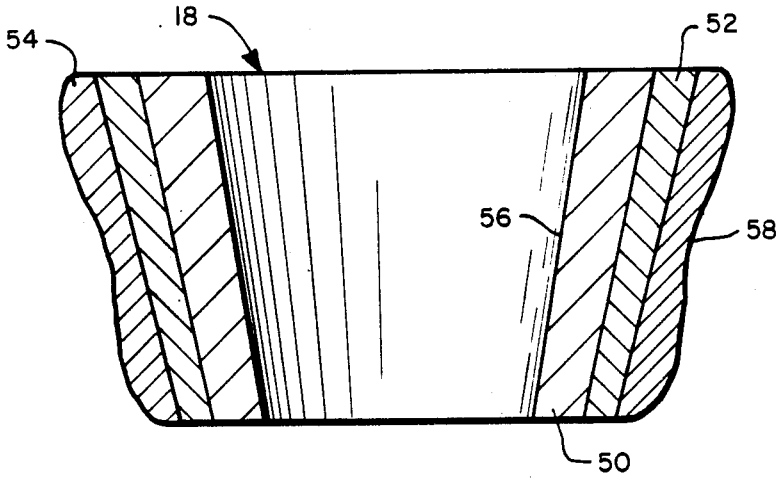
FIG. 3 is a sectional view on an enlarged scale of a pulverized roll constructed in accordance with the present invention and manufactured in accordance with the method of the present invention, illustrating in exaggerated form the uneven nature of the thickness of the outer portion of the pulverizer roll.

For purposes of setting forth a detailed description of the structural nature of a pulverizer roll 18 constructed in accord with the present invention as well as the method by which such a pulverizer roll 18 is manufactured in accord with the present invention, reference will now be had particularly to FIGS. 2 and 3 of the drawing. It is important to take note here to the fact that FIG. 2 in contrast to FIG. 3 is intended to simply provide a general illustration of a pulverizer, i.e., grinding, roll 18 constructed in accord with the present invention. FIG. 3, on the other hand, as will be more fully set forth hereinafter, illustrates with more particularity the specific details of construction of a pulverizer roll 18 that is manufactured in accordance with the present invention.

With the above as a frame of reference, it can be seen from FIGS. 2 and 3 that the grinding roll 18 embodies a trimetal form of construction. More specifically, as best understood with reference to FIGS. 2 and 3, the grinding roll 18 embodies a main body portion, generally designated by reference numeral 50, that embodies the overall configuration of a roll. In addition to the body portion 50, the grinding roll 18 further embodies two other dissimilar portions of material arranged in layered relation to each other as well as to the body portion 50. To this end, one of these two portions, i.e., that denoted generally by the reference numeral 52 in FIGS. 2 and 3 of the drawing, is suitably positioned in superimposed relation to the body portion 50 of the grinding roll 18. Similarly, the other of the aforereferenced two portions, i.e., that denoted generally by the reference numeral 54 in FIGS. 2 and 3 of the drawing, is suitably positioned in superimposed relation to the portion 52.

As further regards the body portion 50 of the grinding roll 18, the latter in accord with the best mode embodiment of the invention is made of a relatively soft, easily machinable material, such as gray iron. Moreover, with particular reference to FIGS. 2 and 3 it can be seen therefrom that the body portion 50 has a passage 56 formed entirely therethrough at substantially the center thereof. The through passage 56 is suitably dimensioned so as to be capable of receiving therewithin in assembled relation thereto the shaft-like member (not shown) to which reference has previously been made hereinbefore, and on which the grinding roll 18 is suitably supported so as to be capable of functioning in the manner described above and as shown in FIG. 1.

Next, with regard to the portion 52, i.e., the intermediate layer, with which the trimetal pulverizer roll 18 is provided, in accord with the best mode of the invention this portion 52 preferably comprises a material that is noted for its medium wear-resistant qualities. In this regard, a material that has been found suitable for use for this purpose is a material referred to by the name Raymix. Raymix, which has a known composition, can be obtained from the Monongahela plant of applicant's assignee. The reasons why a material having such qualities is selected for use in this context, and the manner in which the portion 52 consisting of Raymix preferably is adhered to the body portion 50 will be found set forth with more particularity hereinafter.

The last, i.e., portion 54, of the three portions, which collectively comprise the trimetal pulverizer roll 18 preferably consists, in accord with the best mode embodiment of the invention, of a material that is characterized by the fact that it is highly abrasive resistant. One material, which is suitable for use in this regard, is that known to those skilled in this art as nihard. As in the case of the portion 52 the reasons for employing a material to form the portion 54, i.e., the outer layer of the trimetal pulverizer roll 18 that has the characteristics described above, and the manner in which the portion 54 is affixed to the portion 52 will be found set forth hereinafter with more particularlity.

Suffice it to say at this point, however, that the reasons for constructing the grinding roll 18 from a plurality of dissimilar materials that are arranged in a layered array are as a result of recognition being had first to the fact that there is a need to provide the body portion 50 with the through passage 56, and secondly to the fact that the outer surface of the pulverizer roll 18 is subjected to a harsh abrasive action in the course of effecting the pulverization of coal. The result, therefore, is that on the one hand it is desirable that the body portion 50 be made of a relatively soft, easily machinable material so as to facilitate the formulation therein of the through passage 56. In contradistinction to this, there is a need for at least the outer surface, i.e., that encompassed by the intermediate layer, i.e., portion 52, and the outer layer, i.e., portion 54, to be made of materials that are characterized by their capability to resist wear, and in particular that kind of wear which is occasioned by abrasive action.

Insofar as concerns the illustrations that comprise FIGS. 2 and 3 of the drawing, as was noted previously herein, FIG. 2 is simply intended to illustrate in a general fashion the nature of the construction in accord with the present invention of the pulverizer, i.e., grinding, roll 18. FIG. 3, on the other hand, is intended to illustrate a grinding roll 18 constructed in accordance with the present invention wherein therein is depicted in exaggerated fashion the fact that the outer layer, i.e., portion 54, embodies an uneven thickness in contradistinction to the intermediate layer, i.e., portion 52, which is of substantially uniform thickness. More specifically, the external surface of the outer portion 54, i.e., that denoted by the reference numeral 58 in FIG. 3 is provided with a specific configuration which is intended to constitute a replication of the wear pattern that a pulverization, i.e., grinding, roll 18 develops as a consequence of its being utilized to effect the pulverization of a material such as coal within a bowl mill 10. That is, the external surface 58 of the outer portion 54 of the grinding roll 18 is suitably configured such that those areas thereof which based on past experience it can be anticipated will be subjected to the greatest degree of wear are made to have a thicker thickness of material, e.g., nihard, thereat. The intent in doing so is to attempt to achieve a uniform wear rate of the outer portion 54 by means of providing more material in those areas whereat it is expected that the roll 18 will experience the most wear based on past experience applied to the use to which the roll 18 is intended to be put. To summarize, the outer portion 54 of the pulverizer, i.e., grinding, roll 18 is intentionally made to have a nonuniform thickness such that more material is provided in those areas whereat more wear is predicted to take place, and less material is provided in those areas whereat less wear is expected to occur.

Next, a description will now be had of the method by which in accord with the present invention the pulverizer, i.e., grinding, roll 18 is preferably manufactured. This will then be followed by a description of the benefits that flow from the use of a pulverizer roll 18 which embodies a trimetal form of construction. Insofar as the method of manufacture of the pulverizer roll 18 is concerned, in accord with the best mode embodiment of the invention a centrifugal casting process is employed for this purpose. Proceeding with the description of the subject method, in accord with the first step thereof the requisite amount of material, e.g., Raymix, needed to form the intermediate portion 52 of the pulverizer roll 18 is poured in known fashion into a suitable mold. In accordance with the known techniques of centrifugal casting, the Raymix under the influence of centrifugal force moves outwardly within the mold and forms a layer thereof in abutting engagement to the inner surface of the mold. Once the intermediate portion 52 of the pulverizer roll 18 is formed, the next step in accord with the subject method is to effect the pouring into the mold of the requisite amount of material, e.g., gray iron, to form the inner, i.e., body portion 50 of the pulverizer roll 18. In accord once again with the known techniques of centrifugal casting, the gray iron under the influence of centrifugal force forms a layer in abutting engagement with the inner surface of the intermediate portion 52. A suitable bonding agent is preferably utilized to cause the outer surface of the inner portion 50 to adhere to the inner surface of the intermediate portion 52. After the pulverizer roll 18 has been partially formed in the aforedescribed manner, the partially formed roll 18 is removed from the aforereferenced mold and the outer surface of the intermediate portion 52 to the extent deemed necessary is prepared for receipt thereon of the outer portion 54. This is followed by the affixation of the outer portion 54 to the intermediate portion 52. To this end, in accord with the best mode embodiment of the method of manufacture of the present invention, the outer portion 54 is provided in the form of a weld overlay. Moreover, as described previously hereinbefore, the outer portion 54 preferably is applied in the form of a nonuniform thickness of material such that the thicker thickness thereof is located in those areas whereat it is believed, based on the use to which it is known the pulverizer roll 18 will be put, the greatest wear will be experienced. It is to be noted here that in accord with the method described above, the through passage 56 is formed through substantially the center of the body portion 50 during the casting process. Thus, the need to machine such a passage 56 therethrough is obviated except for any minor machining that may be required to prepare the passage 56 for the receipt therein of the shaft-like member (not shown) on which the pulverizer roll 18 is designed to be mounted in supported relation thereto.

Attention will now be directed to the matter of the benefits that flow from the use of a pulverizer roll that embodies a trimetal form of construction. To this end, those benefits which are to be found enumerated hereinafter are presented by way of exemplification and not limitation. First, the pulverizer roll 18 by virtue of its trimetal form of construction embodies a body portion 50 that is capable of being made from a material that is relatively easy to work thereby enabling economies of manufacture to be realized from the use for this purpose of this material, e.g., gray iron. Secondly, the pulverizer roll 18 that embodies a trimetal structure has an external surface that consists of an outer portion 54 which consists of a relatively hard, i.e., highly abrasive resistant material such as nihard that is capable of resisting the abrasive action produced in the course of effecting the pulverization therewith of a material such as coal. Moreover, because of the fact that the outer portion 54 is provided with a thicker thickness of material in the areas which are most subject to wear, the pulverizer roll 18 is characterized by the fact that the outer portion 54 wears more slowly, i.e., wears more uniformly. That is, before the outer portion 54 wears through in those areas which are subject to the greatest wear, a more uniform wearing of the entire outer portion 54 is realized.

In addition, it is most important to note here that the external surface of the pulverizer roll 18 is not composed of simply the outer portion 54. But rather, the external surface further comprises the intermediate portion 52, which also consists of a material having wear-resistant qualities, e.g., Raymix. As a consequence, even when the outer portion 54 is worn through, the pulverizer roll 18 still remains serviceable in that the intermediate portion 52 is also capable of performing the wear-resisting function. It is of course true that the material which comprises the intermediate portion 52 is not as hard, i.e., is not as abrasive resistant as the outer portion 54. Nevertheless, the pulverizer roll 18 is still capable of being used with the intermediate portion 52 exposed, i.e., serving, as the pulverizing surface. The significance of this is that continued usage may be made of the pulverizing roll 18. Namely, no longer is it necessary to immediately replace pulverizer rolls when the outer surface thereof wears through for fear of damaging the roll, i.e., so to preclude the resurfacing of the worn roll. In contradistinction, with the pulverizer roll 18 of the present invention it is possible most frequently, to await the next scheduled shutdown of the bowl mill 10 in order to effect the removal and replacement of the roll 18 after the outer portion 54 thereof has worn through. This is because the intermediate portion 52 serves as an adequate surface to effect the continued pulverization therewith of coal within the bowl mill 10. Normally, the life of the intermediate portion 52 before it also wears through is such as to enable a sufficient period of time to expire to reach the next scheduled shutdown of the bowl mill 10.

Another advantage that derives from the use of dissimilar materials for the intermediate portion 52 and the outer portion 54 is that it is possible to visually recognize when the outer portion 54 has worn through in one or more places. This visual indication is had by noting the different appearance, e.g., color, etc. of each of the two dissimilar materials, i.e., the Raymix of intermediate portion 52 and the nihard of outer portion 54. To further enhance this visual recognition, it is possible to color with a suitable medium, e.g., red paint, the outer surface of the intermediate portion 52 so as to provide the latter with a readily viewable surface before the outer portion 54 is affixed thereto.

In summary, not only does the pulverizer roll 18 constructed in accordance with the present invention provide a roll that has a measurably longer operating life than do the rolls which have heretofore been constructed in accordance with the teachings of the prior art, but also the pulverizer roll 18 is characterized by the fact that even when the outer portion 54 thereof becomes worn through, by virtue of the presence of the intermediate portion 52 continued usage may be made of the pulverizer roll 18 for effecting the pulverization of a material without the roll 18 sustaining damage thereto. This obviates the need to experience many of those shutdowns of the bowl mill 10 which have been occasioned heretofore by the need to accomplish the removal and replacement of a pulverizer roll that had been constructed in accordance with the teachings of the prior art. Lastly, by providing the outer portion 54 with a nonuniform thickness, additional wear is obtainable from the pulverizer roll 18 before the outer portion 54 thereof wears through; namely, those areas of the outer portion 54 which experience shows are subjected to the greatest wear are provided with the thickest layer of material.

Thus, in accordance with the present invention there has been provided a new and improved form of pulverizer roll. Moreover, the pulverizer roll of the present invention is characterized in that it embodies a trimetal mode of construction. In addition, in accord with the present invention a trimetal pulverizer roll is provided that is primarily intended to be employed in a bowl mill for purposes of effecting the pulverization therewithin of a material such as coal. Further, the trimetal pulverizer roll of the present invention is distinguishable by its relatively long operating life. Additionally, in accordance with the present invention a trimetal pulverizer roll is provided which has a first portion thereof that is characterized by its ease of machinability, a second portion thereof that is characterized by the fact that it exhibits medium wear-resistant qualities, and a third portion thereof that is characterized by the fact that it exhibits highly abrasive resistant qualities. Also, the trimetal pulverizer roll of the present invention while being readily employable in a bowl mill yet also enables significant cost savings to be realized through the use thereof insofar as the operation of the bowl mill is concerned. Furthermore, in accord with the present invention a new and improved method of manufacturing such a trimetal pulverizer roll is provided.

While only one embodiment of my invention has been shown, it will be appreciated that modifications thereof, some of which have been alluded to hereinabove, may still be readily made thereto by those skilled in the art. I, therefore, intend by the appended claims to cover the modifications alluded to herein as well as all the other modifications, which fall within the true spirit and scope of my invention.

What is claimed is:

1. A pulverizer roll for use in a bowl mill for purposes of effecting the pulverization of material therewithin comprising:

a. a first portion made of gray iron cast as a complete element having a substantially circular outer surface, said first portion being of uniform thickness and having a through passage formed therein suitably dimensioned so as to be capable of receiving therewithin a member operative for effecting the mounting thereon of the pulverizer roll in supported relation thereto;

b. a second portion made of a medium wear-resistant material cast as a complete element having a substantially circular inner surface and a substantially circular outer surface, said second portion being of a uniform thickness and being superimposed on said first portion in layered relation thereto with said inner surface of said second portion positioned so as to be in engagement with said outer surface of said first portion;

c. a bonding agent deposited on said outer surface of said first portion, said bonding agent being operative to effect the adherence of said outer surface of said first portion to said inner surface of said second portion;

d. a third portion made of a highly abrasive resistant material deposited as a weld overlay on said outer surface of said second portion, said third portion having an external surface specifically configured so as to replicate the predicted wear pattern to which the outer surface of the pulverizer roll will be subjected when the pulverizer roll is placed in operation; and e. means located on said outer surface of said second portion operative to provide a visual indication of when said third portion has worn through.

2. The pulverizer roll as set forth in claim 1 wherein said second portion is made of Raymix.

3. The pulverizer roll as set forth in claim 1 wherein said third portion is made of Nihard.

4. The pulverizer roll as set forth in claim 1 wherein said means located on said outer surface of said second portion comprises a coating of paint.

* * * * *